US008021188B1

(12) United States Patent
Ma et al.

(10) Patent No.: US 8,021,188 B1
(45) Date of Patent: Sep. 20, 2011

(54) ELECTRICAL CONNECTOR

(75) Inventors: Yuan-Yuan Ma, Guang-Dong (CN); Kai-Hsiang Chang, Tu-Cheng (TW); Kuo-Chin Lin, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/850,020

(22) Filed: Aug. 4, 2010

(51) Int. Cl.
*H01R 13/648* (2006.01)

(52) U.S. Cl. ..... 439/607.55

(58) Field of Classification Search ..... 439/607.55–607.57, 607.27, 607.35, 439/607.54
See application file for complete search history.

(56) References Cited

U.S. PATENT DOCUMENTS 6,997,748 B1 * 2/2006 Su ..... 439/607.55
D616,371 S * 5/2010 Ma et al. ..... D13/147
7,748,999 B1 * 7/2010 Sun et al. ..... 439/79
D626,080 S * 10/2010 Zong ..... D13/147
2010/0022132 A1 * 1/2010 Wang ..... 439/607.27
* cited by examiner

*Primary Examiner* — Ross Gushi
(74) *Attorney, Agent, or Firm* — Cheng-Ju Chiang

(57) ABSTRACT

An electrical connector includes an insulating housing, a terminal pack module, at least one propping element and a shielding shell. A front of the insulating housing defines a receiving space. At least one fastening groove is opened in an outer periphery of the insulating housing. A bottom of the fastening groove defines a fastening hole. A plurality of terminals is received in the insulating housing. The propping element is received in the corresponding fastening groove and has a base portion. An elastic portion is extended frontward from the base portion, and a contacting portion is protruded inward from a free end of the elastic portion for being inserted into the fastening hole to be exposed to the receiving space. A shielding shell encloses the insulating housing and the propping element. The shielding shell has at least one mouth corresponding to the fastening hole and the contacting portion.

8 Claims, 5 Drawing Sheets

ELECTRICAL CONNECTOR

BACKGROUND OF THE INVENTION

1. Field of the Invention

The present invention generally relates to an electrical connector, and more particularly to an electrical connector having a plurality of contacting portions capable of providing a larger insertion-withdrawal force.

2. The Related Art

Generally, a conventional electrical connector includes an insulating housing, a terminal pack module and a shielding shell. The shielding shell has a rectangular sheath with a top plate, two side plates and a bottom plate. The top plate, two side plates and the bottom plate are all punched inward to form a plurality of splinters. When a mating connector is inserted into the sheath, the splinters can elastically clip the mating connector.

However, in order to save a cost and occupying area of the shielding shell, the above-mentioned shielding shell is usually made of a material with small thickness and poor elasticity. Each of the splinters is punched from the shielding shell, so the splinter can only provide weaker elasticity and causes a deformation and damage easily. Furthermore, when the splinter is damaged, the whole shielding shell needs to be changed so as to cause the high mending cost.

SUMMARY OF THE INVENTION

An object of the present invention is to provide an electrical connector. The electrical connector includes an insulating housing, a terminal pack module, at least one propping element and a shielding shell. A front of the insulating housing defines a receiving space. At least one fastening groove is opened in an outer periphery of the insulating housing and extends along a front-to-rear direction. A bottom of the fastening groove defines a fastening hole communicated with the receiving space at a front end thereof. A plurality of terminals is received in the insulating housing. The propping element is received in the corresponding fastening groove. The propping element has a base portion. An elastic portion is extended frontward from the base portion, and a contacting portion is protruded inward from a free end of the elastic portion for being inserted into the fastening hole to be exposed to the receiving space. A shielding shell encloses the insulating housing and the propping element. The shielding shell has at least one mouth corresponding to the fastening hole and the contacting portion of the propping element.

As described above, the propping element is made of metal materials with larger thickness and larger elasticity. As a result, when a mating connector is inserted into the receiving space of the receiving housing, the contacting portion, can contact with the mating connector with larger elastic force. And deformation of the propping element won't occasionally happen. Furthermore, when the propping element is damaged, only the damaged propping element needs to be changed to lower a mending cost.

BRIEF DESCRIPTION OF THE DRAWINGS

The present invention will be apparent to those skilled in the art by reading the following description, with reference to the attached drawings, in which.

DETAILED DESCRIPTION OF THE EMBODIMENT

Figure 1:
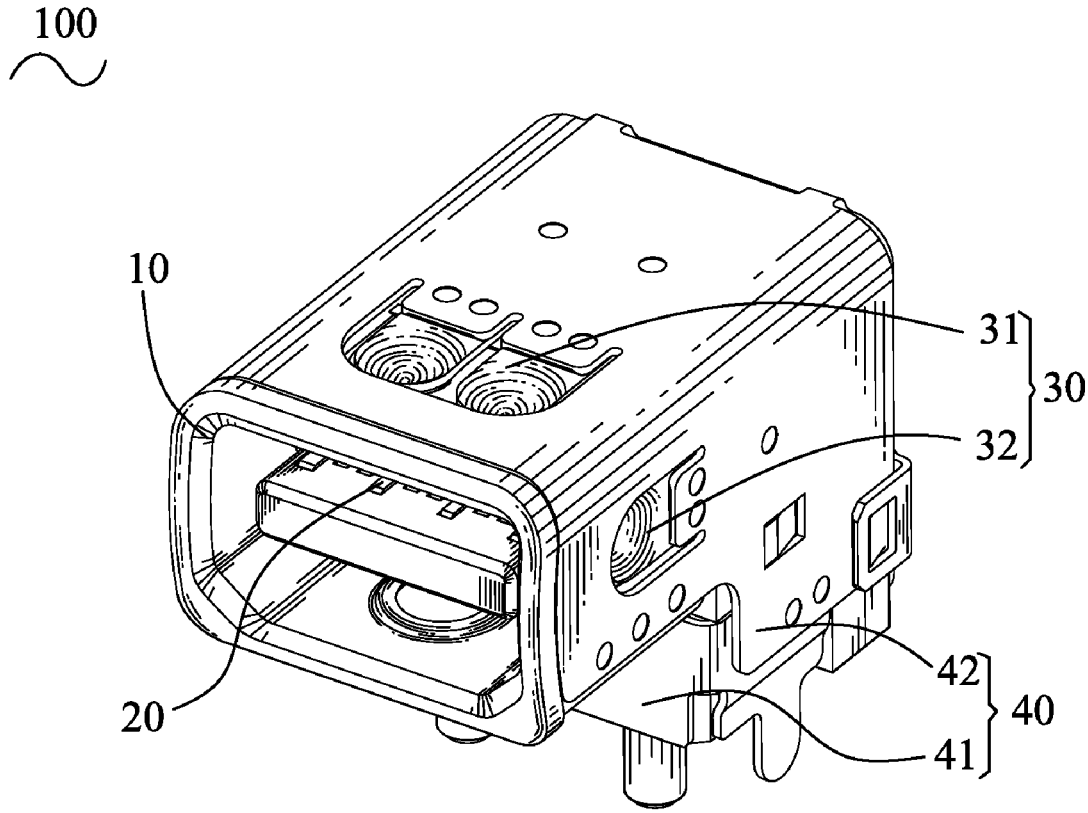
FIG. 1 is a perspective view of an electrical connector according to the present invention.
Figure 2:
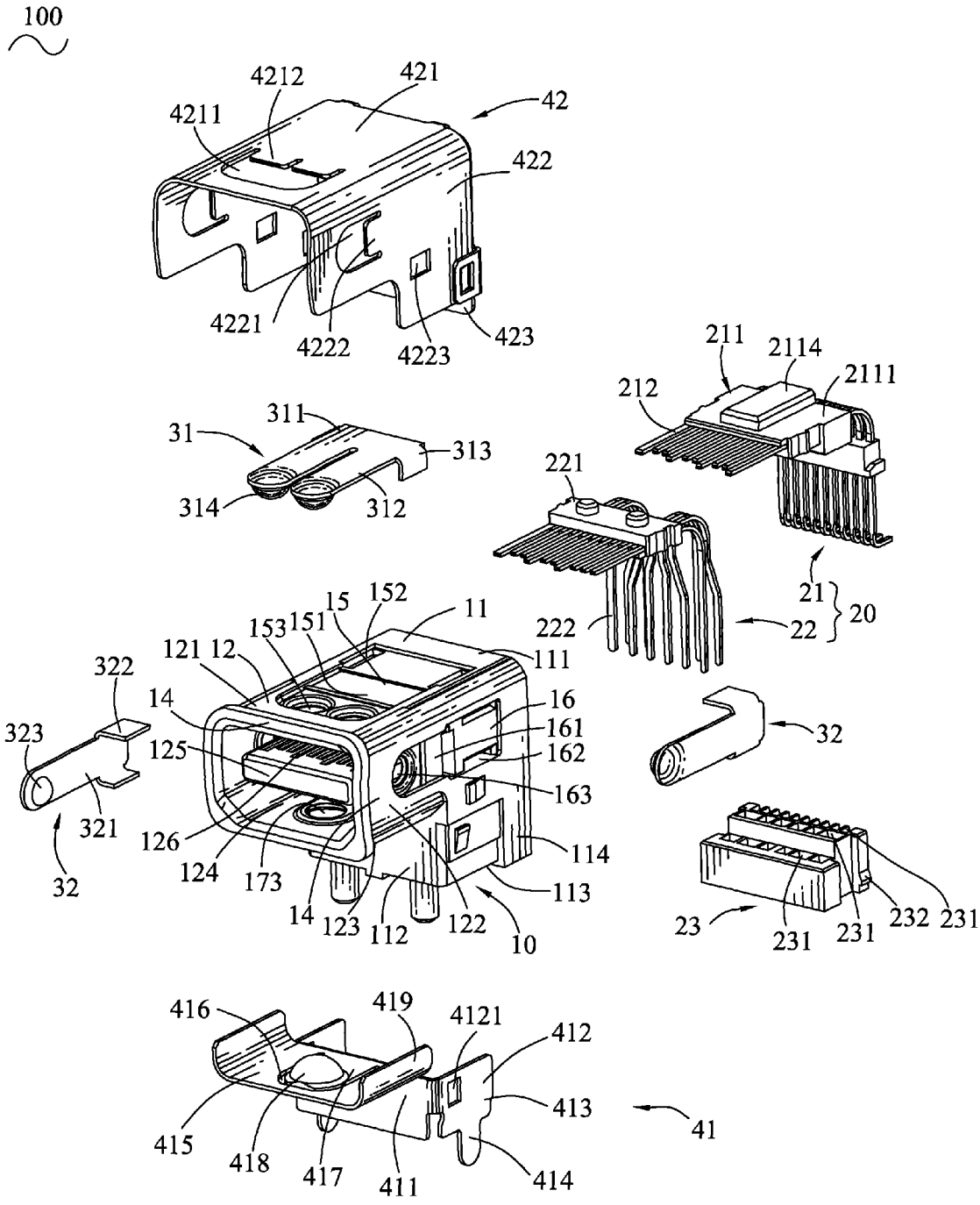
FIG. 2 is an exploded perspective view of the electrical connector of FIG. 1.

Referring to FIG. 1 and FIG. 2, an electrical connector 1 in accordance with the present invention includes an insulating housing 10, a terminal pack module 20 received in the insulating housing 10, a plurality of propping elements 30 and a shielding shell 40.

Figure 3:
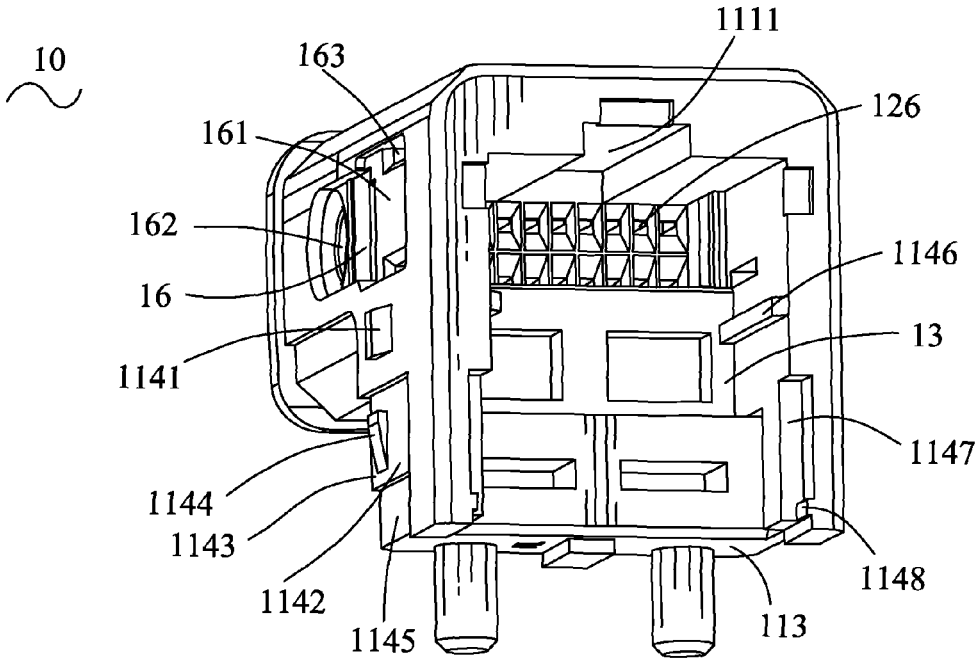
FIG. 3 is a rear view of an insulating housing of the electrical connector of FIG. 2.

Referring to FIGS. 2-3, the insulating housing 10 has a rectangular base portion 11 with a top barrier 111, a front barrier 112 perpendicular to the top barrier 111, a bottom barrier 113 opposite to the top barrier 111, and two side barriers 114 connecting with the front barrier 112 and the rear barrier 113 which are interconnected to define an accommodating chamber 13 thereamong. A receiving housing 12 is protruded forward from an upper portion of the front barrier 112 and shows a hollow rectangular box-shape with a top wall 121, two opposite side walls 122 and a bottom wall 123 which are connected together to define a receiving space 124 thereamong. A tongue portion 125 is protruded forward into the receiving space 124 from a middle of the front barrier 112. A top face and a bottom face of the tongue portion 125 define a plurality of terminal grooves 126 abreast arranged at regular intervals and extending longitudinally to penetrate through the front barrier 112. A front edge of an outer periphery of the receiving housing 12 is protruded outward to form a flange 14.

Figure 4:
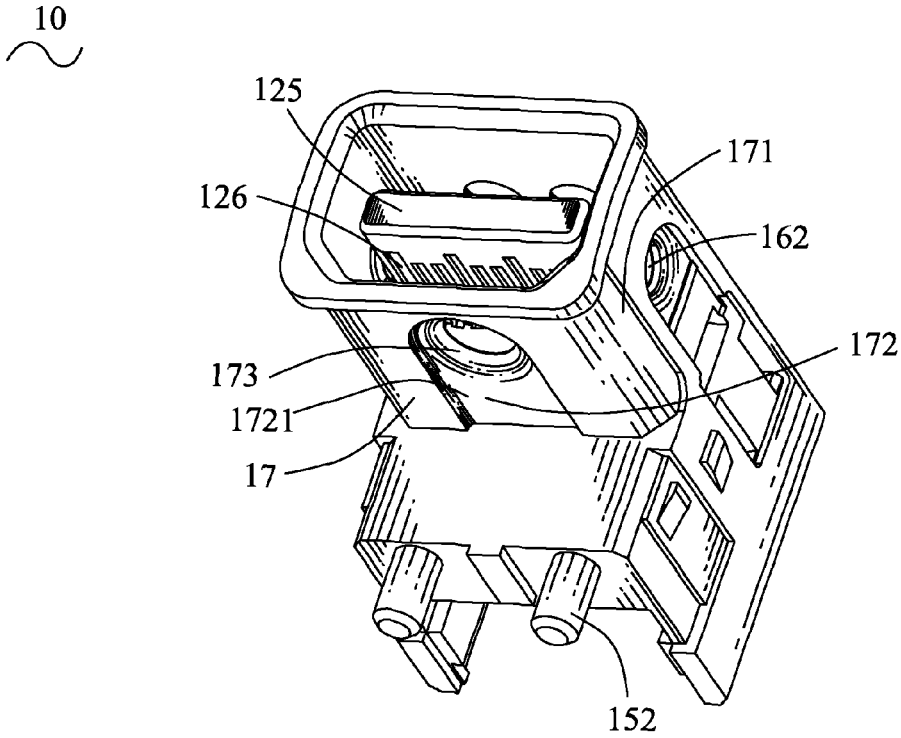
FIG. 4 is a front view of the insulating housing of the electrical connector of FIG. 2.

Referring to FIGS. 2-4, a middle of a top of the top wall 121 is concaved inward to form a substantial rectangular first fastening groove 15 extending longitudinally to the top barrier 111. Two rear portions of two sides of a first bottom face 151 of the first fastening groove 15 respectively define a first fastening slot 152. A front end of the first bottom face 151 of the fastening groove 15 abreast defines two first fastening holes 153 spaced from each other and communicated with the receiving space 124. A middle of each side wall 122 is concaved inward to form a second fastening groove 16 extending longitudinally to the side barrier 114. Two rear portions of two sides of a second bottom face 161 of the second fastening groove 16 respectively define a second fastening slot 162. A front end of the second bottom face 161 defines a second fastening hole 163 communicated with the receiving space 124. A middle of a bottom of the bottom wall 123 defines an opening groove 17 located between the flange 14 and the front barrier 112, and passing through bottoms of the two side walls 122. A middle of a third bottom face 171 of the opening groove 17 is concaved inward to form a third fastening groove 172. A front of a fourth bottom face 1721 of the third fastening groove 172 defines a third fastening hole 173 communicated with the receiving space 124. A middle of an outer side of each side barrier 114 protrudes outward to form a first protrusion 1141. A bottom of the outer side of the side barrier 114 is concaved inward to form a buckling groove 1142. An upper portion of an inner side wall 1143 of the buckling groove 1142 protrudes outward to form a second protrusion 1144. A lower part of the inner side wall 1143 is concaved inward to form a buckling passage 1145. A middle of a bottom of the top barrier 111 is concaved upward to form a guiding recess 1111. Middles of inner sides of the two side barriers 114 protrude face to face to form two propping portions 1146. Bottoms of rear portions of the inner sides of the side barriers 114 define two locating slots 1147, respectively. Two bottoms of two opposite sidewalls of the two locating slots 1147 protrude face to face to form two supporting blocks 1148.

Figure 5:
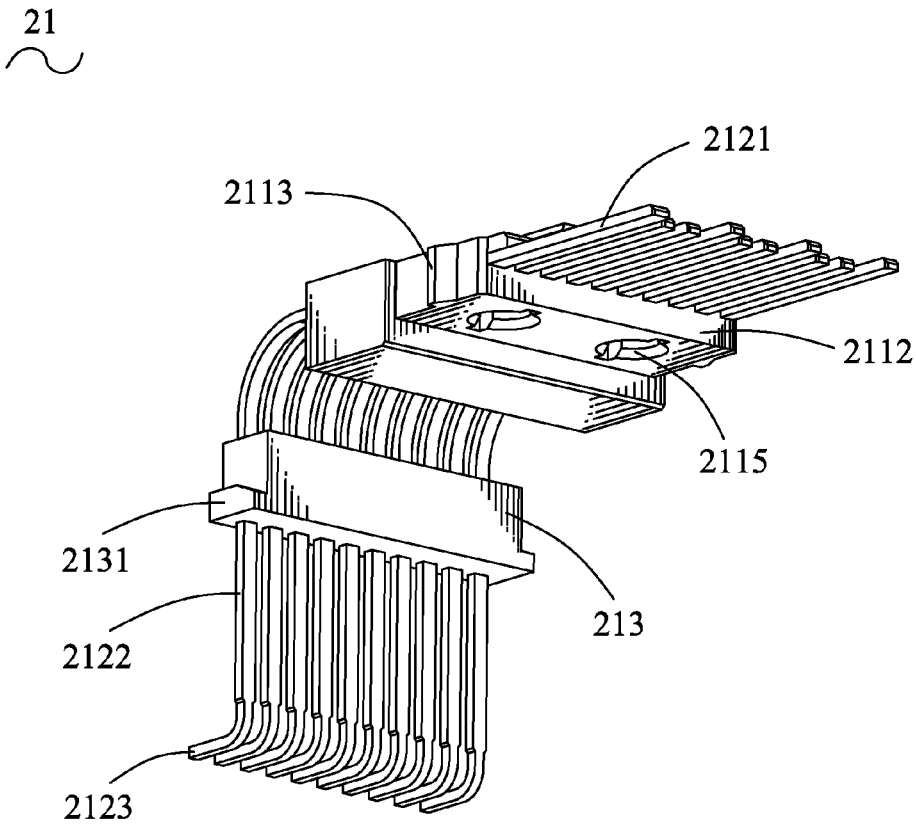
FIG. 5 is a perspective view of a first terminal pack of the electrical connector of FIG. 2.

Referring to FIG. 2 and FIG. 5, the terminal pack module 20 includes a first terminal pack 21 and a second terminal pack 22. The first terminal pack 21 includes a first base body 211 and a plurality of first terminals 212. The first base body 211 has a base block 2111. A top of a front of the base block 2111 protrudes forward to form a connecting block 2112 with two first fastening blocks 2113 being protruded outward from two end edges thereof. A middle of a top of the first base body 211 protrudes upward to form a guiding block 2114 extending longitudinally. A bottom of the connecting block 2112 defines two circular assembling cavities 2115 spaced from each other. Each of the first terminals 212 has a first contacting arm 2121 of elongated shape. A rear end of the contacting arm 2121 is bent downward to form a first inserting arm 2122. A free end of the first inserting arm 2122 is bent towards a direction opposite to the contacting arm 2121 to form a soldering arm 2123. A rear of the contacting arm 2121 is molded to the first base body 211 integrally. A substantial middle of the first inserting arm 2122 is molded to an auxiliary block 213. Two auxiliary protrusions 2131 are protruded from two bottoms of two end edges of the auxiliary block 213. The soldering arm 2123 is soldered to a printed circuit board (not shown).

Figure 6:
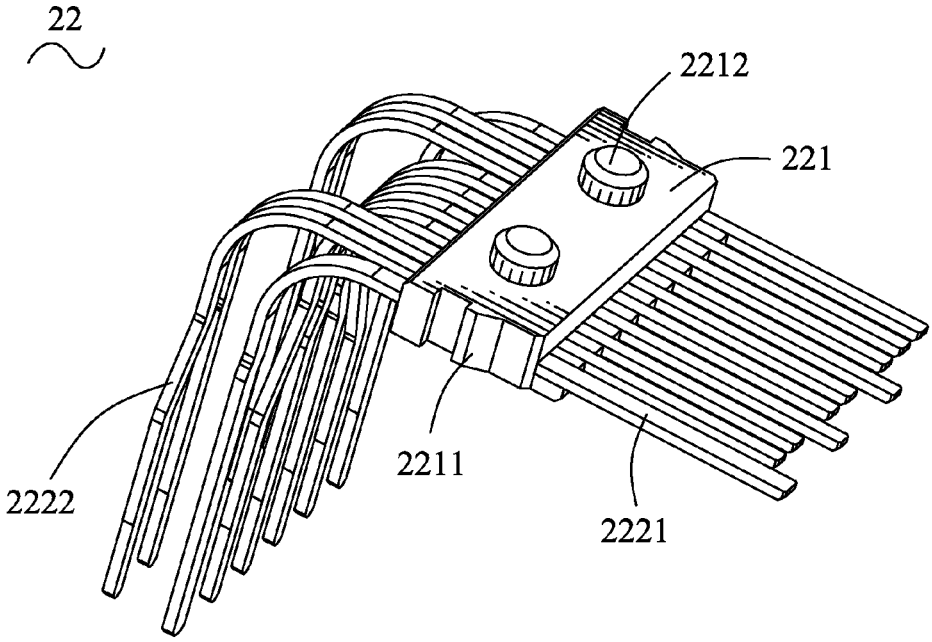
FIG. 6 is a perspective view of a second terminal pack of the electrical connector of FIG. 2.
Figure 7:
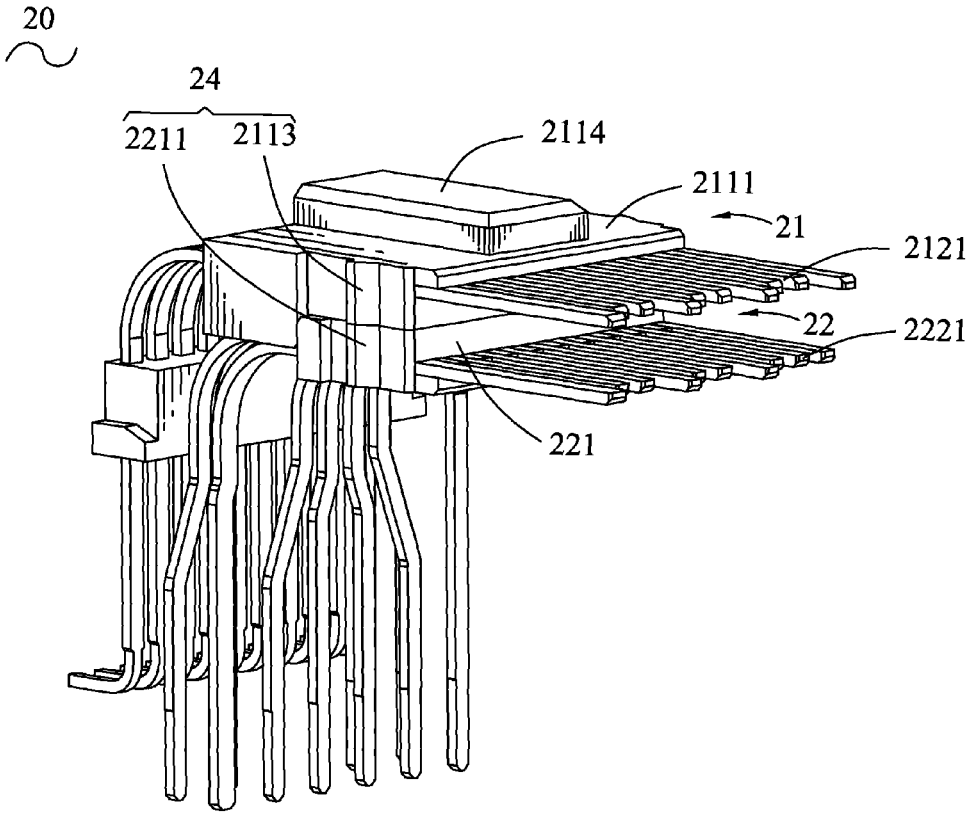
FIG. 7 is a perspective view of a terminal pack module of the electrical connector of FIG. 2.
Figure 8:
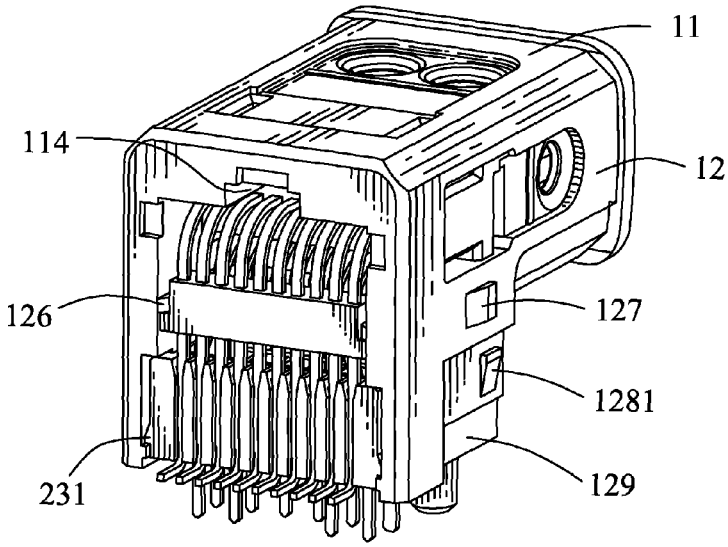
FIG. 8 is an assembling view of the terminal pack module of the electrical connector of FIG. 7 and the insulating housing of the electrical connector of FIG. 2.

Referring to FIG. 2, and FIG. 6, the second terminal pack 22 includes a second base body 221 and a plurality of second terminals 222. Two end edges of the second base body 221 protrude outward to form two second fastening blocks 2211. Two portions of a top of the second base body 221 protrude upward to form two assembling pillars 2212 spaced from each other. Each of the second terminals 222 has a second contacting arm 2221 of elongated shape. The second contacting arm 2221 is bent downward to form a second inserting arm 2222. A rear of the second contacting arm 2221 is molded to the second base body 221 integrally. The second inserting arm 2222 is soldered to the printed circuit board (not shown). The second inserting arms 2222 are divided into a front and rear rows to increase a retention force between the second terminals 222 and the printed circuit board (not shown).

Referring to FIG. 2, FIG. 5, FIG. 6 and FIG. 7, when the terminal pack 20 is assembled, the first terminal pack 21 is positioned on the second terminal pack 22. The assembling pillars 2212 are inserted into the assembling cavities 2115. The first fastening blocks 2113 and the second fastening blocks 2211 are engaged with each other to from a fastening block 24. The first inserting arms 2122 and the second inserting arms 2222 are arranged at three rows along a front-to-rear direction to avoid electromagnetic interferences between the first and second terminals 212, 222 during a signal transmission. A locating base 23 of a substantially rectangular configuration defines three upright rows of inserting holes 231 along a front-to-rear direction for receiving the first inserting arms 2122 and the second inserting arms 2222 therein so as to avoid deformations of the first and second terminals 212, 222. Two assembling blocks 232 are protruded oppositely from two end edges of the locating base 23.

Referring to FIG. 1 and FIG. 2, the propping elements 30 include a first propping element 31 and two second propping elements 32. The first propping element 31 has a first base portion 311 of rectangular plate shape. Two portions of a front side of the first base portion 311 extend forward to form two first elastic portions 312 spaced from each other. Two ends of the first base portion 311 extend downward to form two first inserting portions 313. A front of a bottom of each first elastic portion 312 protrudes downward to form a dome-shaped first contacting portion 314. The second propping element 32 has a rectangular second base portion 321. Two ends of a rear of the second base portion 321 extend towards a same direction perpendicular to the second base portion 321 to form two second inserting portions 322. A front of an inner side of the second base portion 321 protrudes towards the same direction as the second inserting portion 322 to form a dome-shaped second contacting portion 323.

Referring to FIG. 1 and FIG. 2, the shielding shell 40 includes a first shielding shell 41 and a second shielding shell 42. The first shielding shell 41 has a first rectangular base plate 411. Two top portions of two ends of the first base plate 411 are bent towards a same direction perpendicular to the first base plate 411 to form two first buckling plates 412 with two face to face buckling holes 4121 being punched from front portions thereof. A bottom of each of the first buckling plates 412 extends inward then downward to form a second buckling plate 413. A middle of a bottom of the second buckling plate 413 extends downward to form a soldering plate 414. A top of the first base plate 411 is bent opposite to the first buckling plate 412 to form a propping plate 415. A first mouth 416 is opened in a middle of the propping plate 415 and extending longitudinally. A rear end of the first mouth 416 extends frontward to form a fastening splinter 417. A front of the splinter 417 protrudes upward to form a semi-spheroidal third contacting portion 418. Two ends of the propping plate 415 are bent upward to form two fastening plates 419.

Referring to FIG. 2 again, the second shielding shell 42 has a rectangular second base plate 421. Two sides of the second base plate 421 extend downward to form two side plates 422 with a bottom of a front thereof being cut off. A rear end of the second base plate 421 extends downward to form a rear plate 423. A front of the second base plate 421 defines a second mouth 4211. Two portions of a rear end of the second mouth 4211 extend forward to form two first fastening pieces 4212. A front of each side plate 422 defines a third mouth 4221. A rear end of each third mouth 4221 extends forward to form a second fastening piece 4222. A substantial middle of each side plate 422 defines a matching hole 4223.

Referring to FIGS. 1-8, when the electrical connector 100 is assembled, the first and second inserting arms 2122, 2222 of the terminal pack module 20 are inserted into the corresponding inserting holes 231 of the locating base 23, firstly. Then, the terminal pack module 20 with the locating base 23 is inserted forward into the accommodating chamber 13 of the insulating housing 10. The first and second contacting arms 2121, 2221 are inserted into the terminal grooves 126. The guiding block 2114 is received in the guiding recess 1111. The fastening blocks 24 are located on tops of the propping portions 1146. Two auxiliary protrusions 2131 abut against bottoms of the propping portions 1146. Two ends of the locating base 23 are received in the locating slots 1147 with the assembling blocks 232 abutting against two tops of the supporting blocks 1148. The first propping element 31 is received in the first fastening groove 15. The first inserting portions 313 are inserted into the first fastening slots 152. The first contacting portions 314 are inserted into the first fastening holes 153 to be exposed in the receiving space 124 of the receiving housing 12. The second propping element 32 is received in the second fastening groove 16. The second inserting portions 322 are inserted into the second fastening slots 162. The second contacting portions 323 are inserted into the second fastening holes 163 to be exposed in the receiving space 124. The first shielding shell 41 is covered on a bottom of the insulating housing 10. The propping plate 415 is received in the opening groove 17 with a front thereof abutting against a rear of a bottom of the flange 14. The fastening splinter 417 is received in the third fastening groove 172. The propping portion 418 is inserted into the third fastening hole 173 to be exposed in the receiving space 124. The fastening plates 419 abut against two ends of the third bottom face 171. The first buckling plates 412 are received in the buckling grooves 1142. The second buckling plates 413 are received in the buckling passages 1145. The second protrusions 1144 are received in the buckling holes 4121. The second shielding shell 42 is covered on a top of the insulating housing 10 with a front thereof abutting against a rear of a top of the flange 14. The second shielding shell 42 is soldered together with the first propping element 31, the second propping element 32 and the first shielding shell 41. The first fastening pieces 4212 abut against outer sides of the first elastic portions 312 and outer sides of the first contacting portions 314 are exposed from the second mouth 4211. The second fastening pieces 4222 abut against outer sides of the second base portions 321 and outer sides of the second contacting portions 323 are exposed from the third mouth 4221. The first protrusions 1141 are received in the matching holes 4223.

As described above, the first propping element 31, the second propping elements 32 and the fastening splinter 417 are made of metal materials with larger thickness and larger elasticity. As a result, when a mating connector is inserted into the receiving space 124 of the receiving housing 12, the first contacting portions 314, the second contacting portions 323 and the propping portion 418 can contact with the mating connector and provide larger elastic force. And deformations of the first propping element 31, the second propping element 32 and the fastening splinter 417 won't occasionally happen. Furthermore, when one of the first propping element 31, the second propping elements 32 and the fastening splinter 417 is damaged, only the damaged element need be changed to lower a mending cost.

What is claimed is:

1. An electrical connector, comprising:

an insulating housing, a front of the insulating housing defining a receiving space, at least one fastening groove being opened in an outer periphery of the insulating housing and extending along a front-to-rear direction, a bottom of the fastening groove defining a fastening hole communicated with the receiving space at a front end thereof;

a plurality of terminals received in the insulating housing;

at least one propping element received in the corresponding fastening groove, the propping element having a base portion, an elastic portion extended frontward from the base portion, and a contacting portion protruded inward from a free end of the elastic portion for being inserted into the fastening hole to be exposed to the receiving space; and a shielding shell enclosing the insulating housing and the propping element, the shielding shell having at least one mouth corresponding to the fastening hole and the contacting portion of the propping element.

2. The electrical connector as claimed in claim 1, wherein the contacting portion is substantial dome shape.

3. The electrical connector as claimed in claim 1, wherein a fastening piece is extended frontward into the mouth from a rear side of the mouth for pressing the elastic portion.

4. The electrical connector as claimed in claim 1, wherein the base portion of the propping element further includes two inserting portions bent from two opposite sides thereof for being inserted into corresponding fastening slots defined in two opposite sides of a rear of the fastening groove.

5. The electrical connector as claimed in claim 1, wherein the insulating housing has a rectangular base portion and a receiving housing extended from an upper portion of a front of the base portion thereof, the receiving space is defined in a front surface of the receiving housing, the shielding shell includes a first shielding shell and a second shielding shell, the second shielding shell includes a second base plate covered on tops of the rectangular base portion and the receiving housing of the insulating housing, two sides of the second base plate extend downward to form two side plates with a bottom of a front thereof being cut off for being covered on sides of the rectangular base portion and the receiving housing.

6. The electrical connector as claimed in claim 5, wherein the first shielding shell has a first rectangular base plate covered on a lower portion of the front of the rectangular base portion of the insulating housing, two ends of the first base plate are bent towards a same direction perpendicular to the first base plate to form two first buckling plates sandwiched between the two sides of the rectangular base portion of the insulating housing and the side plates of the second shielding shell, a top of the first base plate is bent opposite to the first buckling plate to form a propping plate covered on a bottom of the receiving housing, a first mouth is opened in a middle of the propping plate, a rear end of the first mouth extends frontward to form a fastening splinter, a front of the splinter protrudes upward to form a propping portion inserted into a third fastening hole defined in the bottom of the receiving housing to be exposed to the receiving space.

7. The electrical connector as claimed in claim 6, wherein the propping portion is substantial dome shape.

8. The electrical connector as claimed in claim 1, wherein a top and two sides of the insulating housing define respective fastening grooves and fastening holes for receiving respective propping elements.

* * * * *